US005143683A

United States Patent [19]

Glassman et al.

[11] Patent Number: 5,143,683

[45] Date of Patent: Sep. 1, 1992

[54] PROTECTIVE SHIELD HAVING HEAT CONDUCTIVE PROPERTIES

[75] Inventors: Barry S. Glassman, Belair, Md.; Philip D. Stelts, Center Valley, Pa.; Joseph W. Hlinka, Bethlehem, Pa.; Charles R. Beechan, Bethlehem, Pa.; Lester A. Foster, Jr., Baltimore, Md.

[73] Assignee: Bethlehem Steel Corporation, Bethlehem, Pa.

[21] Appl. No.: 716,888

[22] Filed: Jun. 18, 1991

[51] Int. Cl.[5] ..... C21C 5/50

[52] U.S. Cl. ..... 266/246; 266/245

[58] Field of Search ..... 266/245, 246, 903, 287

[56] References Cited

U.S. PATENT DOCUMENTS

| | | | |
|---|---|---|---|
| 94,997 | 9/1869 | Bessemer | 266/246 |
| 340,000 | 4/1886 | Nicholson | 266/245 |
| 554,457 | 2/1896 | Price | 266/246 |
| 3,153,110 | 10/1964 | Sherburn et al. | 266/246 |
| 3,163,696 | 12/1964 | Johansson et al. | 266/246 |
| 3,169,755 | 2/1965 | Eklund et al. | 263/245 |
| 3,182,979 | 5/1965 | Krause | 263/245 |
| 3,193,272 | 7/1965 | Kramer et al. | 266/246 |
| 3,201,108 | 1/1963 | Kramer | 266/246 |
| 3,313,619 | 4/1967 | DeCamps | 75/60 |
| 3,345,058 | 10/1967 | Pere | 266/246 |
| 3,376,029 | 4/1968 | Menu | 266/246 |
| 3,381,951 | 5/1968 | Gaines et al. | 266/246 |
| 3,427,081 | 7/1967 | Dellinger | 308/15 |
| 3,632,097 | 1/1972 | Schurr | 266/246 |
| 3,652,072 | 3/1972 | Stresemann et al. | 266/246 |
| 3,682,460 | 8/1972 | Pieper et al. | 266/246 |
| 3,682,623 | 10/1970 | Dierckx et al. | 75/76 |
| 3,695,602 | 10/1972 | Mevissen | 266/246 |
| 3,734,479 | 5/1973 | Atkinson | 266/246 |
| 3,838,849 | 10/1974 | Alexander et al. | 266/246 |
| 4,149,706 | 4/1979 | Graaf | 266/243 |

FOREIGN PATENT DOCUMENTS

| | | | |
|---|---|---|---|
| 2520382 | 7/1983 | France | 266/246 |

OTHER PUBLICATIONS

Iron and Steel Engineer, Sep. 1971, "How to Design Against Operational Problems on Basic Oxygen Vessels", by E. C. Langmead, p. 121.

"BOF Steelmaking, vol. Three-Design", Copyright Dec. 1976, Chapter 7-Vessel Design, by M. L. Wel et al., pp. 48 and 96.

Henson, *Special Refractories*, American Foundryman, Dec. 1947 pp. 64–70.

*Primary Examiner*—Scott Kastler

*Attorney, Agent, or Firm*—Harold I. Masteller, Jr.

[57] ABSTRACT

A shield comprising a refractory material resistant to pentration by a continuous stream of molten steel and a retaining means to hold the refractory material contiguous to a heat absorption surface.

8 Claims, 5 Drawing Sheets

11
15
8
24
10
13
12
14
9
22
17
26
2
23
2
16
25
20
19

33
36
31
37
35
30
32
10
9
27
28
29
34
5

PROTECTIVE SHIELD HAVING HEAT CONDUCTIVE PROPERTIES

BACKGROUND OF THE INVENTION

This invention relates to a protective shield for use on a basic oxygen steelmaking furnace. Such furnaces, known in the art as a BOF, comprise large open ended steelmaking vessels which have thick refractory linings for protecting their outer steel shells from the molten metal and high temperatures contained within the vessels during the refining process. Such BOF vessels are usually mounted within a water-cooled trunnion ring which permits rotation of the vessel about a horizontal axis for charging and tapping operations and also functions as a heat sink transferring heat away from the hot steelmaking vessel walls.

Even though the BOF vessel is protected from the high refining temperatures by both its thick refractory lining and the heat sink effect of the water-cooled trunnion ring, there have been instances when the molten steel, being refined within the vessel, has burned through both the refractory lining and outer steel shell of the vessel. When such unexpected failures happen, the molten steel can erupt from the burn through area within the vessel wall and penetrate the water-cooled trunnion ring causing a massive steam explosion and considerable damage to the furnace and surrounding facilities. These occasional, violent explosions, have led to attempts to develop protective shields located at strategic positions along the inside wall of the water-cooled trunnion ring. However, past protective shield designs have failed because when such structures are installed within the narrow confines between the BOF trunnion ring and the steelmaking vessel they interrupt normal transfer of heat from the hot steelmaking vessel to the cooling water within the trunnion ring, radiate heat back toward the BOF vessel, and cause hot spots within the vessel wall resulting in structural damage.

SUMMARY OF THE INVENTION

It has been found that protective shields, installed between the water-cooled trunnion ring and a steelmaking vessel must posses high heat conductivity properties to insure an adequate transfer of heat from the hot steelmaking vessel to the cooling water within the trunnion ring. It has also been found that in order to facilitate maximum heat transfer, a protective shield must make considerable surface contact with the inside wall of the trunnion ring. In addition, it has been found that a protective shield must be both resistant to penetration by molten steel and relatively light in weight to prevent a large change in the vessel's center of gravity which would adversely effect shop safety when the vessel is tilted during charging and pouring operations. And finally, a protective shield must be thin enough to fit within the limited space between the water-cooled BOF trunnion ring and the steelmaking vessel and yet be able to withstand damage from falling debris.

It is therefore an object of this invention to provide a protective shield which is both heat conductive and resistant to penetration by molten steel.

It is a further object of this invention to provide a protective shield having considerable contact with an adjacent trunnion ring surface.

It is still a further object of this invention to provide a thin, light weight protective shield which will not adversely effect the center of gravity of the vessel.

I have discovered that the foregoing objects can be attained with a protective shield comprising a conductive refractory material resistant to molten steel penetration cast within a container formed by attaching a conductive shell to a heat absorption means.

DETAILED DESCRIPTION OF THE PREFERRED EMBODIMENT

Figure 1:
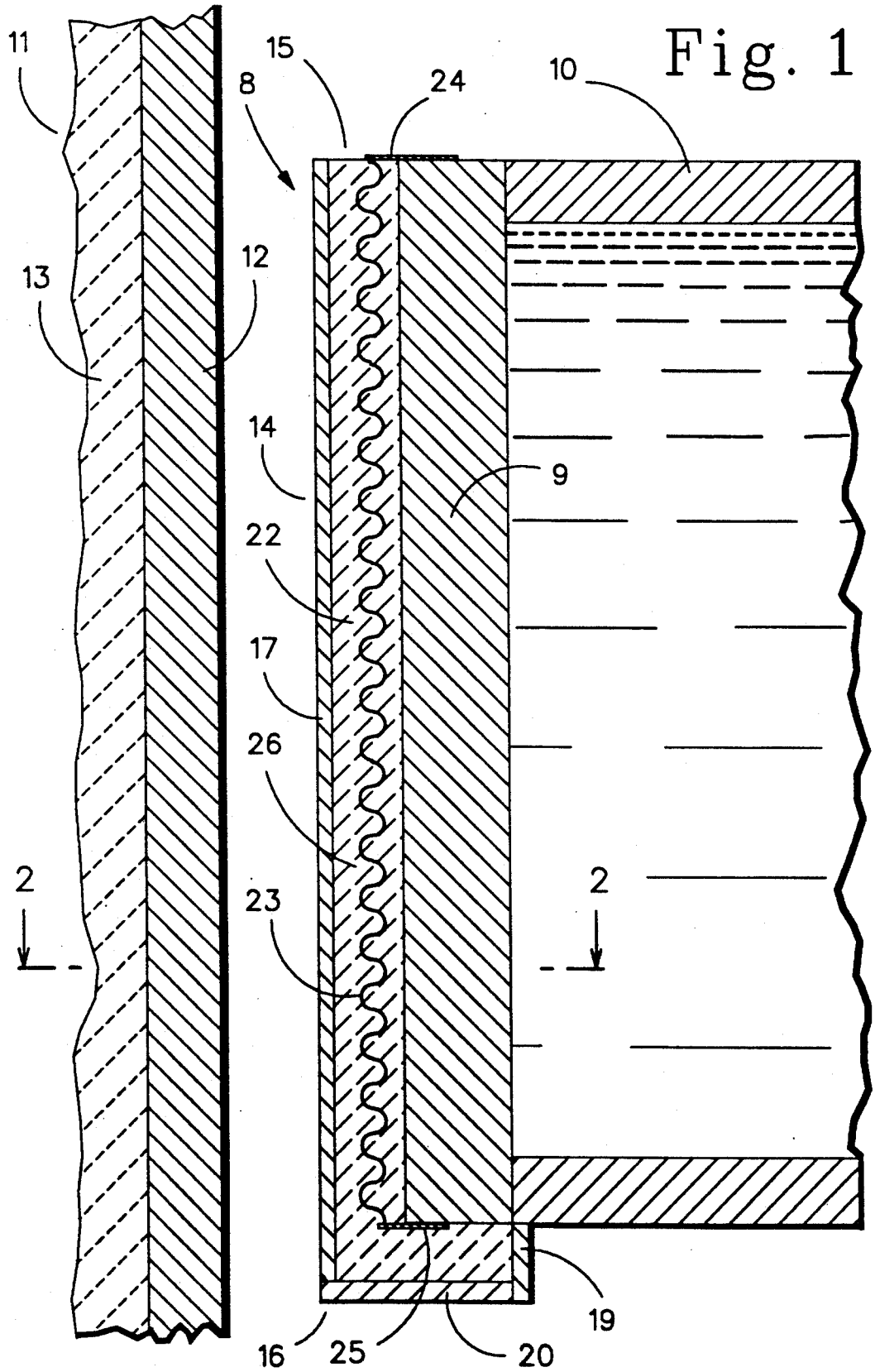
FIG. 1 is a cross-sectional view of a portion of a steelmaking furnace showing a protective shield installed adjacent the inside wall of a water-cooled trunnion ring.
Figure 3:
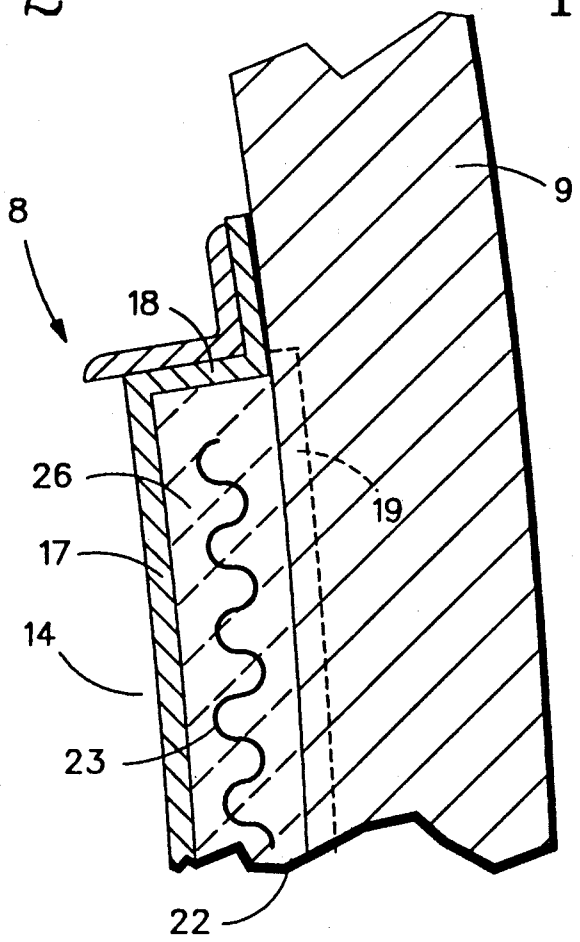
FIG. 3 is an enlarged portion of the protective shield shown in FIG. 2.
Figure 2:
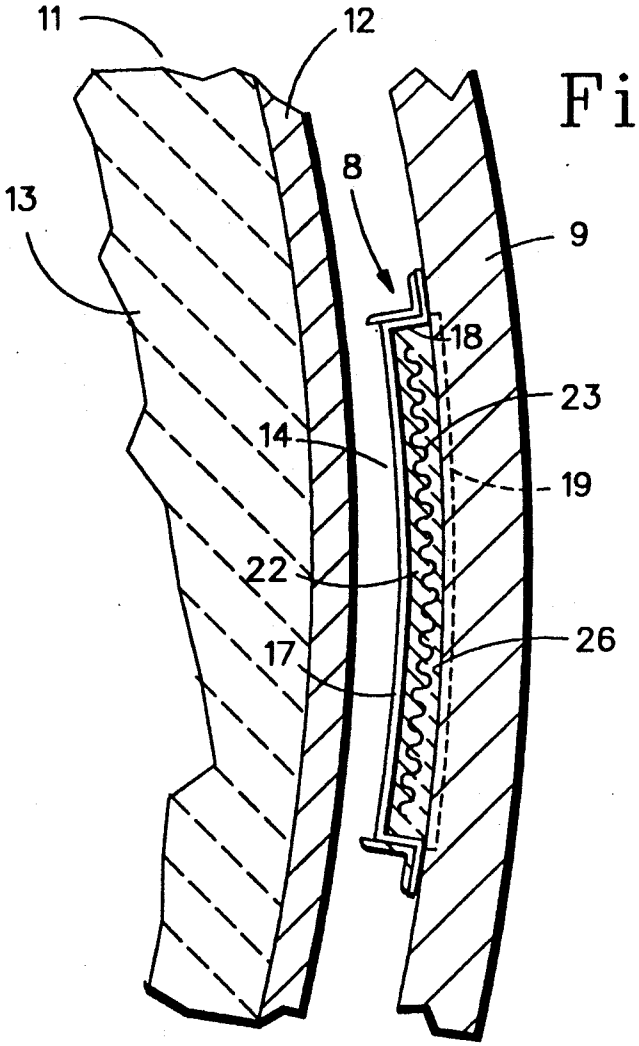
FIG. 2 is a cross-sectional view taken along the lines 2—2 of FIG. 1.

Referring to FIGS. 1-3 of the drawings, the preferred embodiment of the invention shows one of a plurality of shields which are strategically located along the surface of an inside wall 9 of a water cooled trunnion ring 10. The protective shield 8, shown in the drawings, is located adjacent an area of the steelmaking vessel 11 which is predisposed to molten steel burn through. Each protective shield 8 is contiguous with the inside wall 9 of a water-cooled trunnion ring 10 which supports the steelmaking vessel 11 and the steelmaking vessel includes an outer steel shell 12 and in inner refractory lining 13. The protective shield 8 comprises a pair of spaced apart curved plates 17 and 19 connected by a base plate 20. The first curved plate 17 is substantially parallel to the inside wall 9 of the water-cooled trunnion ring 10 and includes a pair of extending angle shaped side plates 18 attached to the inside wall 9 forming a box like container 14 having a hollow chamber 22, an open end 15 and a closed opposite end 16 at base plate 20. The second, shorter, curved plate 19, of box like container 14, is attached to the lower portion of the water-cooled trunnion ring 10 and reinforcing wire or mesh 23 extends from an upper fastener plate 24 downward between the first curved plate 17 and inside wall 9 to a lower fastener plate 25 forming an anchoring means for a castable refractory material 26 which is poured into the hollow chamber 22.

The material used for the construction of the box like container 14 must be a highly conductive material such as steel in order to properly transfer heat to the trunnion ring cooling water, and, as shown in the following test data, the castable refractory material 26, within the box like container 14, must be silicon carbide or another material having similar heat conductive and penetration resistant properties.

Figures 4, 5:
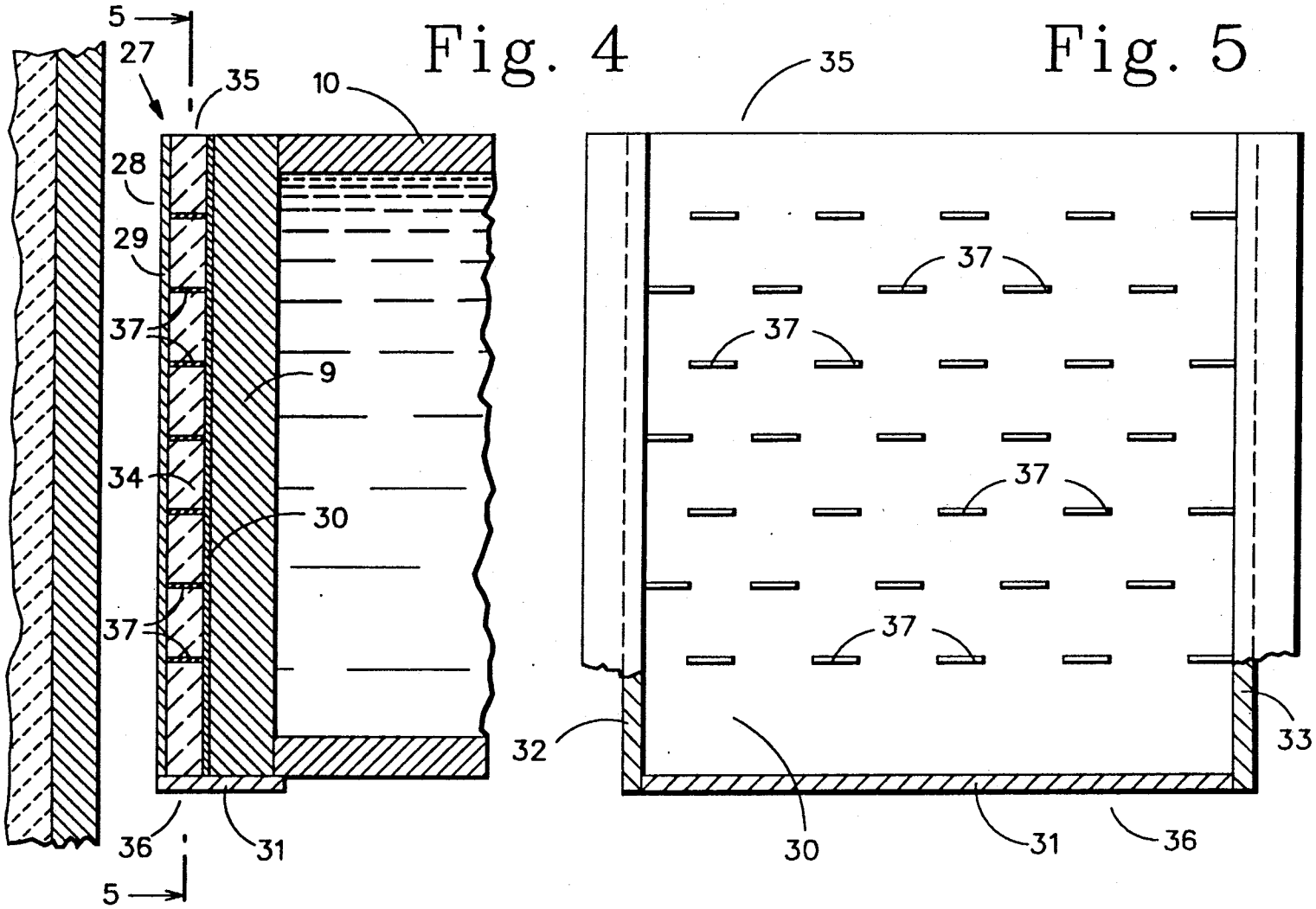
FIG. 4 is a cross-sectional view similar to FIG. 1 showing an alternate embodiment of the invention.
FIG. 5 is a cross-sectional view taken along the lines 5—5 of FIG. 4.

Referring to FIGS. 4 and 5 of the drawings, an alternate embodiment 27, of the protective shield invention, is shown comprising a box like container 28, for receiving a castable refractory material 38, having a pair of spaced apart curved plates 29 and 30 connected by a base plate 31 and side plates 32 and 33 to form a box like container 34 having an open end 35 and an closed opposite end 36.

A plurality of spaced apart stiffener plates 37 extend between the first curved plate 29 and second curved plate 30 and stiffner plates 37 provide an anchoring means for the castable refractory material 38 which is poured into the box like container 34. As shown in FIG. 5, plates 37 are arranged symmetrically in parallel, staggered rows which provide open gaps between the plates to permit free flow of the castable material 38 when it is poured into the container 34. However, it should be understood, that plates 37 can be arranged randomly within container 34 as long as open gaps are provided between plates 37 to permit the castable refractory material 38 to flow freely when poured into container 38.

Figure 6:
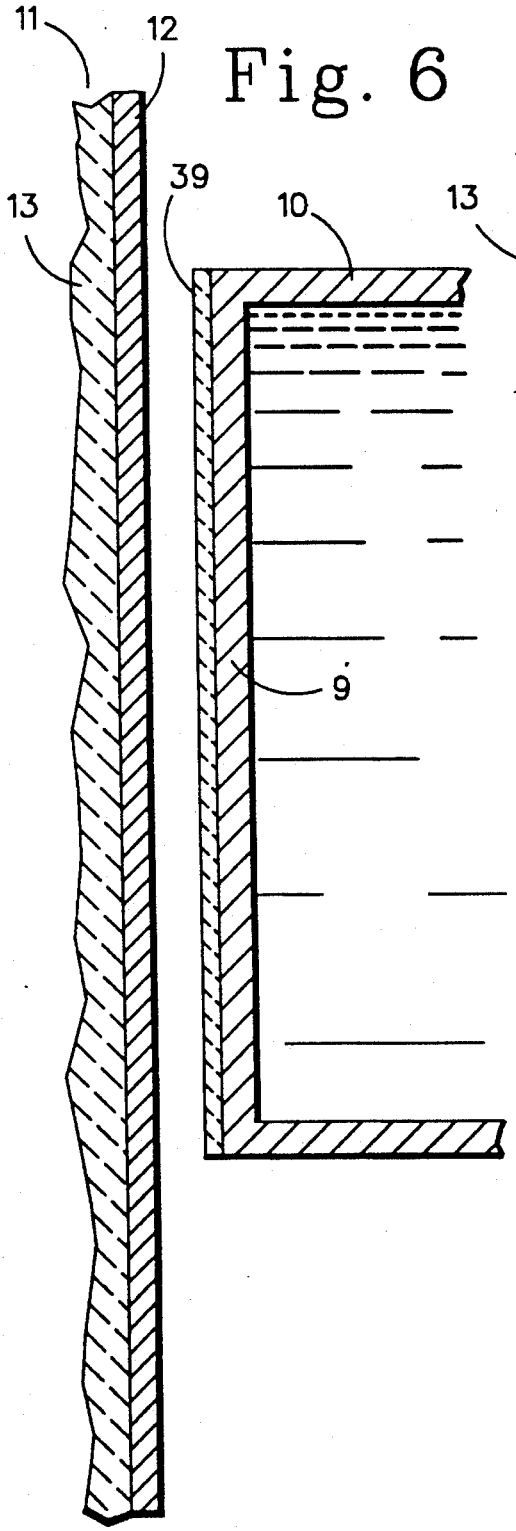
FIG. 6 is a cross-sectional view showing a second alternate embodiment of the invention.
Figure 7:
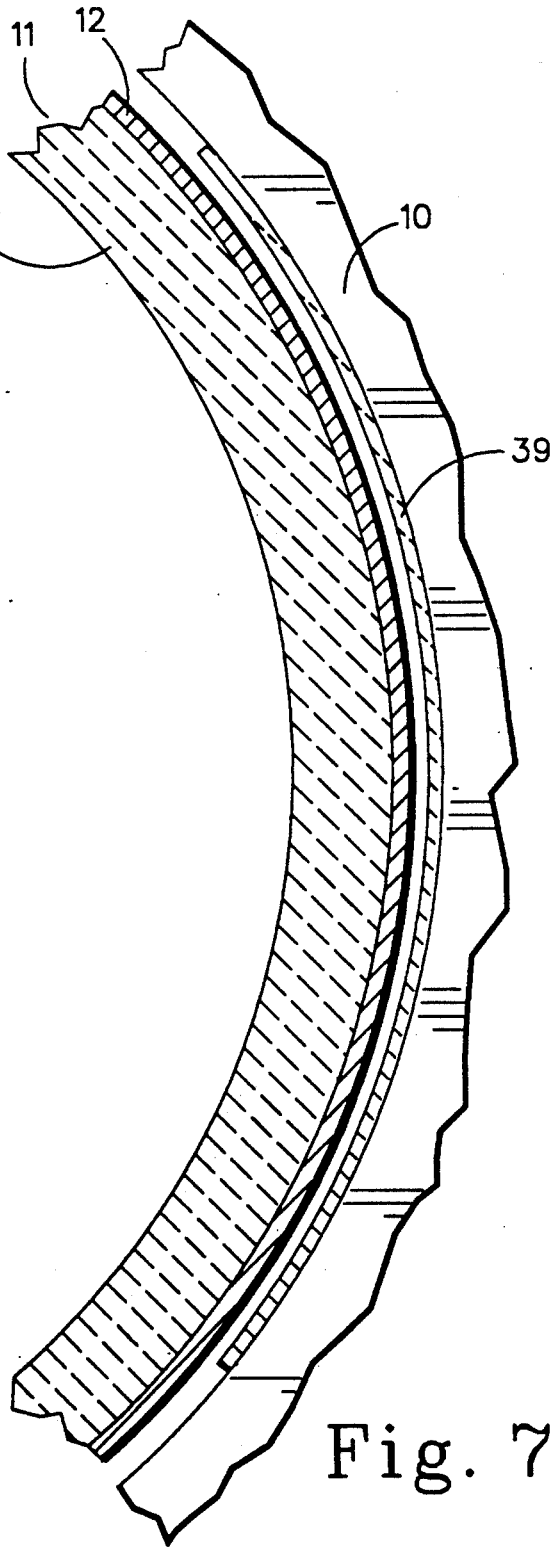
FIG. 7 is a cross-sectional view taken along the lines 7—7 of FIG. 6.

Referring to FIGS. 6 and 7 of the drawings, a second alternate embodiment of the invention is shown to comprising a precast protective shield 39 conforming to the contour of the surface of the inside trunnion ring wall 9. The precast protective shield is made from silicon carbide and is bonded and/or mechanically fastened to the inside wall surface by any suitable means well known in the art.

Figure 8:
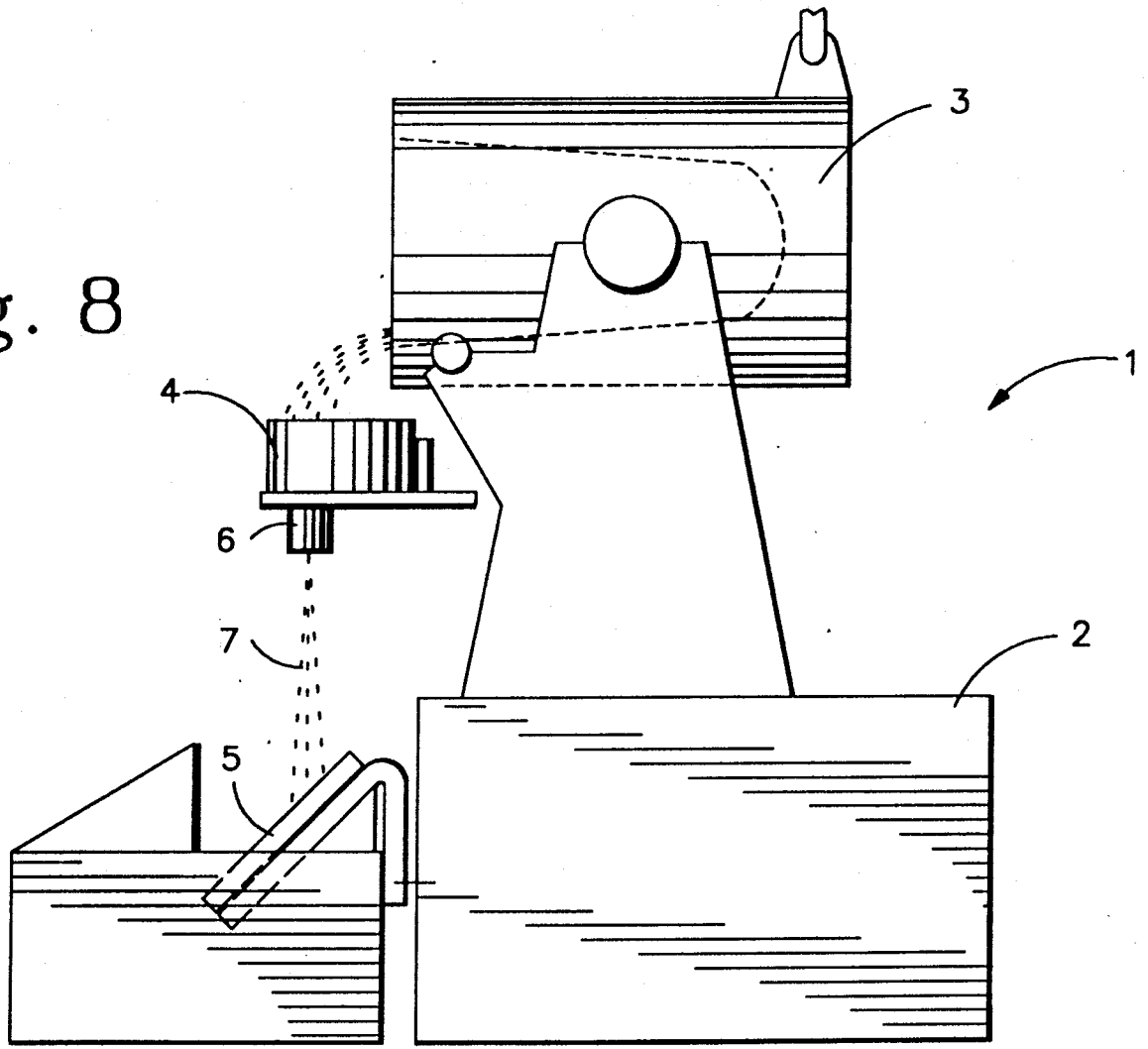
FIG. 8 is an schematic view of test apparatus used to evaluate various protective shield materials.

Having discovered that a protective shield installed adjacent the inside wall of a water-cooled trunnion ring on a tiltable steelmaking furnace must be both resistant to penetration by molten steel and highly conductive to enable heat to be transferred from the hot steelmaking vessel into the cooling water flowing through the trunnion ring, tests were conducted on various heat shield materials using the molten steel penetration test apparatus as shown in FIG. 8 of the drawings. Referring to FIG. 8, the test apparatus 1 comprises a support stand 2, a 1,200 pound capacity induction furnace 3, a tundish 4 for containing a reservoir of molten steel for discharge onto the shield test specimen 5, and a nozzle 6 for controlling the stream 7 of molten steel being discharged onto the test specimen. The test specimen 5 is inclined at about a 45° angle to reduce and control splashing of hot metal at the test area, decrease slag build up on the test specimen and allow the test specimen to be exposed to a continuing fresh stream of molten steel throughout the penetration test. Each of the various materials tested was subjected to a continuous stream of molten steel until the specimen was either completely burned through or the entire 1,200 pound heat of molten test metal was depleted.

Prior to testing, it was discovered that in order for a protective shield material to be successful, it must, (a) be able to withstand penetration from molten steel for a period of 2 to 3 minutes and, (b) the presence of the protective shield material between the steelmaking vessel and the water cooled trunnion ring cannot cause the outside shell temperature of the steelmaking vessel to increase by more than about 100° F. where the steelmaking vessel has an 8" thick refractory brick lining. As shown in the following [Table-A], the silicon-carbide test specimen was found to be the material most resistant to molten steel penetration among the various materials tested.

TABLE-A

| TEST NO. | SHIELD MATERIAL | TAP TEMP. | TUNDISH TEMP. | BURN THROUGH SECONDS |
|---|---|---|---|---|
| 1 | Base Test 16" × 16" × 1" Steel Plate | 3026° F. | 2950° F. | 25 |
| 2 | Plasma Fusion Weld Overlay On 1" Steel Plate 0.010" Tungsten Carbide Base, 0.015" Zirconium Silicate Top | 3155° F. | 3100° F. | 14.84 |
| 3 | Steel Hexmesh w/Alusa Castable, 70.8% Al, 23.3% Si | 3150° F. | 3100° F. | 21.62 |
| 4 | TZM Plate, 99.25 Mo | 3140° F. | 3100° F. | 67 |
| 5 | Cast Iron | 3137° F. | 3100° F. | 9.25 |
| 6 | Ceramic Fiber Sandwich | 3153° F. | 3100° F. | 8.13 |
| 7 | Graphite Block | 3169° F. | 3100° F. | 31.1 |
| 8 | Silicon Carbide Block | 3163° F. | 3100° F. | 49 No Burn Through |
| 9 | Cast Iron Grating w/ Ramming Mix Refractory, 85% Alumina | 3120° F. | 3100° F. | 29 |
| 10 | Silicon Carbide Containing Ramming Mix | 3120° F. | NOT GIVEN | 82 |
| 11 | 100% Silicon Carbide Castable | 3127° F. | NOT GIVEN | 140 No Burn Through |
| 12 | PP-22 Molybdenum Plate | 3130° F. | NOT GIVEN | 89 |

As shown in the following [Table-B], conductivity calculations were made on some of the materials exposed to the above molten steel penetration test. Knowing that effective heat transfer would be reduced by less than perfect surface contact along the inside wall of the trunnion ring, the conductivity calculations were preformed using a criteria which simulated gaps between the shield and trunnion ring wall. The first calculations were based on a shield design having a 0.012" air gap between the shield and the trunnion ring wall, and the second calculations were based on a 0.25" air gap between the two surfaces.

TABLE B (BASED ON A BOF VESSEL HAVING AN 8" THICK REFRACTORY LINING)

| NO. | SHIELD MATERIAL (1" Thick Specimens) | GAP INCHES | VESSEL TEMP. °F. | TEMP. INCREASE |
|---|---|---|---|---|
| 1 | NONE | NA | 1022.00 | NA |
| 2 | Plasma Fusion Weld | 0.012 | 1058.64 | 36.64 |

TABLE B-continued (BASED ON A BOF VESSEL HAVING AN 8" THICK REFRACTORY LINING)

| NO. | SHIELD MATERIAL (1" Thick Specimens) | GAP INCHES | VESSEL TEMP. °F. | TEMP. INCREASE |
|---|---|---|---|---|
| | Overlay On 1" Steel Plate 0.010" Tungsten Carbide Base, 0.015" Zirconium Silicate Top | 0.25 | 1175.71 | 153.71 |
| 5 | Cast Iron | 0.012 | 1052.55 | 30.55 |
| | | 0.25 | 1165.89 | 143.89 |
| 6 | Ceramic Fiber | 0.012 | 1049.96 | 27.96 |
| | Sandwich | 0.25 | 1161.45 | 139.45 |
| 7 | Graphite Block | 0.012 | 1050.26 | 28.26 |
| | | 0.25 | 1162.37 | 140.37 |
| 11 | Silicon Carbide | 0.012 | 1052.91 | 30.91 |
| | Castable | 0.25 | 1166.50 | 144.5 |
| | CONDUCTANCE $17 \frac{BTU}{hr, ft^2, F.°}$ | | | |
| 12 | PP-22 Molybdenum | 0.012 | 1050.97 | 28.97 |
| | Plate | 0.25 | 1161.63 | 139.33 |

Based on the calculation results shown in [Table-B], in addition to being highly resistant to molten steel penetration, silicon carbide also possesses good heat conductive properties making it a suitable material for use as a protective shield adjacent a water cooled trunnion ring in a BOF steelmaking vessel.

We claim:

1. In a water cooled trunnion ring supporting a tiltable steelmaking vessel, the water cooled trunnion ring including an inside wall having a surface facing said vessel, said inside wall being disposed in an concentrically spaced relationship to said vessel and providing a gap therebetween, wherein the improvement comprises one or more shields for protecting said water cooled trunnion ring from molten steel erupting from a vessel wall burn through, each said shield positioned within said gap and comprising:

a) a refractory material resistant to a continuous stream of molten steel for a period of at least 140 seconds and having a conductance $$\geqq 17 \frac{BTU}{hr, ft^2, °F.},$$

said refractory material attached to and contiguous with said inside wall surface facing said vessel, whereby said refractory material being contiguous with said inside wall surface facilitates conduction of heat from said vessel into said water cooled trunnion ring, and b) retaining means attached to said water cooled trunnion ring, said retaining means supporting said refractory material contiguous with said inside wall surface facing said vessel.

2. The invention recited in claim 1 wherein said refractory material contiguous with said surface facing said vessel is a castable.

3. The invention recited in claim 1 wherein said refractory material contiguous with said inside wall surface facing said vessel is silicon carbide.

4. The invention recited in claim 1 wherein each said shield includes anchoring means embedded within said refractory material contiguous with said inside wall surface facing said vessel.

5. The invention recited in claim 1 wherein said retaining means comprising:

a) a first plate radially spaced from said inside wall surface facing said vessel and positioned within said gap, said first plate having an upper facing said vessel, a lower portion, and a pair of side members, each side member extending between said upper portion and said lower portion in a direction toward said inside wall surface facing said vessel and attached thereto, b) a second plate attached to a lower portion of said trunnion ring and extending in a downward direction therefrom, c) a base plate extending between said first plate and said second plate, said base plate, first plate, second plate, and inside wall surface facing said vessel forming a container having a closed end and an open end to receive said refractory material contiguous with said inside wall surface facing said vessel, said refractory material filling a span between said first plate and said inside wall surface facing said vessel to facilitate conduction of heat from said vessel into said water cooled trunnion ring, and d) a mesh grid within said span, said mesh grid extending between said open end and said closed end, said mesh grid embedded within said refractory material contiguous with said inside wall surface facing said vessel.

6. The invention recited in claim 1 wherein said retaining means comprising:

a) a first plate radially spaced from said inside wall surface facing said vessel and positioned within said gap, said first plate having an upper portion, a lower portion, and a pair of side members, each side member extending between said upper portion and said lower portion in a direction toward said inside wall surface facing said vessel and attached thereto, b) a second plate extending between said pair of side members and contiguous with said inside wall surface facing said vessel, c) a base plate extending between said first plate and said second plate, said baseplate, first plate, and second plate forming a container having a closed end and an open end to receive said refractory material, said refractory material filling a span between said first plate and said second plate to facilitate conduction of heat from said vessel into said water cooled trunnion ring, and d) a plurality of stiffener plates extending between said first plate and said second plate, each stiffener plate embedded within said refractory material filling said span between said first and second plates.

7. In a water cooled trunnion ring supporting a tiltable steelmaking vessel, the water cooled trunnion ring including an inside wall having a surface facing said vessel, said inside wall being disposed in an concentrically spaced relationship to said vessel and providing a gap therebetween, wherein the improvement comprises one or more shields for protecting said water cooled trunnion ring from molten steel erupting from a vessel wall burn through, each said shield positioned within said gap and comprising: a precast refractory material resistant to a continuous stream of molten steel for a period of at least 140 seconds and having a conductance $$\geqq 17 \frac{\text{BTU}}{\text{hr, ft}^2, {}^\circ\text{F.}},$$

said precast refractory material bonded to and contiguous with said inside wall surface facing said vessel, whereby said refractory material being contiguous with said inside wall surface facing said vessel facilitates conduction of heat from said vessel into said water cooled trunnion ring.

8. The invention of claim 7 in which said precast refractory material contiguous with said inside wall surface facing said vessel is silicon carbide.

* * * * *